US012599226B2

(12) United States Patent
Roberts et al.

(10) Patent No.: US 12,599,226 B2
(45) Date of Patent: Apr. 14, 2026

(54) WORKSTATION

(71) Applicant: InterMetro Industries Corporation, Wilkes-Barre, PA (US)

(72) Inventors: Carey Alan Roberts, Shavertown, PA (US); Adam Leonard Reggie, Wyoming, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 162 days.

(21) Appl. No.: 18/415,276

(22) Filed: Jan. 17, 2024

(65) Prior Publication Data

US 2024/0245211 A1 Jul. 25, 2024

Related U.S. Application Data

(60) Provisional application No. 63/440,798, filed on Jan. 24, 2023.

(51) Int. Cl.

| | |
|---|---|
| ***A47B 21/00*** | (2006.01) |
| ***A47B 9/08*** | (2006.01) |
| ***A47B 9/20*** | (2006.01) |
| ***A47B 21/03*** | (2006.01) |

(52) U.S. Cl.

CPC ..... *A47B 21/0314* (2013.01); *A47B 9/08* (2013.01); *A47B 9/20* (2013.01)

(58) Field of Classification Search

CPC ..... A47B 21/0314; A47B 9/08; A47B 9/20; A47B 2200/0085; A47B 13/021; A47B 13/003; A47B 55/02; A47F 5/083; A47F 5/01; A47F 5/0056; A47F 7/148; B25H 1/02

USPC ..... 108/59, 97, 98, 147.11–147.15, 147.17, 108/156, 157.1; 312/196; 211/106, 119, 211/119.003, 181.1, 90.03; 248/188, 248/188.1, 249

See application file for complete search history.

(56) References Cited

U.S. PATENT DOCUMENTS

| | | | | | |
|---|---|---|---|---|---|
| 3,757,705 | A | * | 9/1973 | Maslow | A47B 57/265 108/147.13 |
| 4,884,702 | A | * | 12/1989 | Rekow | A47F 5/083 248/222.51 |
| 5,165,349 | A | * | 11/1992 | McAllister | A47B 13/021 248/188 |

(Continued)

FOREIGN PATENT DOCUMENTS

| | | | |
|---|---|---|---|
| CH | 670554 | A * | 1/1989 |
| CN | 108068071 | A | 5/2018 |
| EP | 3456220 | B1 | 12/2020 |

OTHER PUBLICATIONS https://www.target.com/p/medera-kitchen-cart-natural-winsome/-/A-54260918#lnk=sametab (Year: 2019).*

(Continued)

*Primary Examiner* — Janet M Wilkens

(74) *Attorney, Agent, or Firm* — Harness, Dickey & Pierce, P.L.C.

(57) ABSTRACT

A workstation including a vertically adjustable tabletop worksurface and a riser system for accommodating above-the-worksurface storage and/or accessories options is disclosed. The workstation is modularly configurable to optimize the workstation's dimensions and features for use in a variety of work tasks and in a variety of work environments.

15 Claims, 9 Drawing Sheets

(56) References Cited

U.S. PATENT DOCUMENTS

| | | | | |
|---|---|---|---|---|
| 5,601,038 | A * | 2/1997 | Welch | A47B 55/02 211/187 |
| 6,568,335 | B2 * | 5/2003 | Hamilton | A47B 17/033 108/50.02 |
| 7,901,018 | B2 * | 3/2011 | Baughman | A47B 77/02 312/317.3 |
| 2004/0084392 | A1 * | 5/2004 | Richter | A47F 5/0838 211/59.3 |
| 2006/0180557 | A1 * | 8/2006 | Weinstein | A47B 55/02 211/90.03 |
| 2006/0249649 | A1 | 11/2006 | Volk et al. | |
| 2007/0039526 | A1 * | 2/2007 | Yang | A47B 13/021 108/157.1 |
| 2009/0114132 | A1 * | 5/2009 | Hsieh | A47B 3/06 108/156 |
| 2017/0224106 | A1 | 8/2017 | Sabounjian et al. | |
| 2019/0343277 | A1 | 11/2019 | Sabounjian et al. | |
| 2020/0288867 | A1 * | 9/2020 | Knapp | A47B 96/20 |

OTHER PUBLICATIONS

Product & Price Guide Jul. 2023 (pp. 74, 77-79), Advance Tabco.
Worktables_Eagle Group_Profit from the Eagle Advantage®_ copyright 2024.
Shelving Solutions_Eagle Group_Profit from the Eagle Advantage®_ copyright 2021.
The Eagle Advantage for Tables_Profit from the Eagle Advantage®_ copyright 2009.
Search Report regarding European Patent Application No. 241535053, dated Jul. 5, 2024.

* cited by examiner

WORKSTATION

CROSS-REFERENCE TO RELATED APPLICATION

This application claims the benefit of U.S. Provisional Application No. 63/440,798, filed on Jan. 24, 2023. The entire disclosure of the above application is incorporated herein by reference.

FIELD

The present disclosure relates to workstation including a tabletop work surface and, more particularly, to a workstation having a vertically adjustable tabletop work surface and a system for accommodating above-the-work surface storage and/or accessories options and which is configurable to optimize the workstation for efficient use for a variety of work tasks and in a variety of work environments.

BACKGROUND

This section provides background information related to the present disclosure which is not necessarily prior art.

Known workstations that include tabletop worksurfaces (e.g., worktables) generally include a fixed height worksurface and offer limited options for changing or modifying the worksurface's overall height above the floor. Typically, such workstations employ support structures having four, fixed-length, vertical posts or columns that are dimensioned for a specific height of the worksurface. Thus, such workstations tend to be customized for particular uses and/or applications, thereby necessitating many different variations to support the variety of customer uses for a workstation.

Further, such known workstations that also include shelving or accessory features above the worksurface introduce still additional variability to the workstation's support structure and its components, further necessitating customization and limiting the variety of applicable uses for the workstation. For example, the fixed-length vertical posts at the rear of the workstation are of a different dimension that the fixed lengths of the vertical posts at the front of the workstation. Additionally, the post lengths may vary still further depending on the application in which the workstation is intended (e.g., the user is seated, standing or a combination).

Therefore, there remains a need for a workstation which is readily adapted to a variety of dimensions and with a variety of features so that the workstation can be configured and/or modified for use for any of variety of work tasks and in any of a variety of work environments.

SUMMARY

This section provides a general summary of the disclosure, and is not a comprehensive disclosure of its full scope or all of its features.

The present disclosure provides a workstation that can include a vertically adjustable tabletop work surface supported above a support surface (e.g., the floor) by a support structure comprising a plurality of support columns or posts and a support post mounting system.

The workstation can also include a riser system for accommodating above-the-worksurface storage and/or accessories options. The riser system can be mounted to and supported by the tabletop. The riser system can include a plurality of riser brackets and a plurality of riser support posts. Each riser support post is attached to and extends vertically upward from a corresponding riser bracket. A cantilever shelf (or other shelf or accessory) can be supported above the work surface by the riser system.

The workstation is modular and can be configured to a variety of dimensions and with a variety of features so the workstation can be optimized for use in any of a variety of work tasks and in any of a variety of work environments.

The modular workstation of the present disclosure exhibits a clean and appealing shape, configuration and overall ornamental appearance.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding references indicate corresponding parts or features throughout the several views of the drawings.

DESCRIPTION

Figure 1:
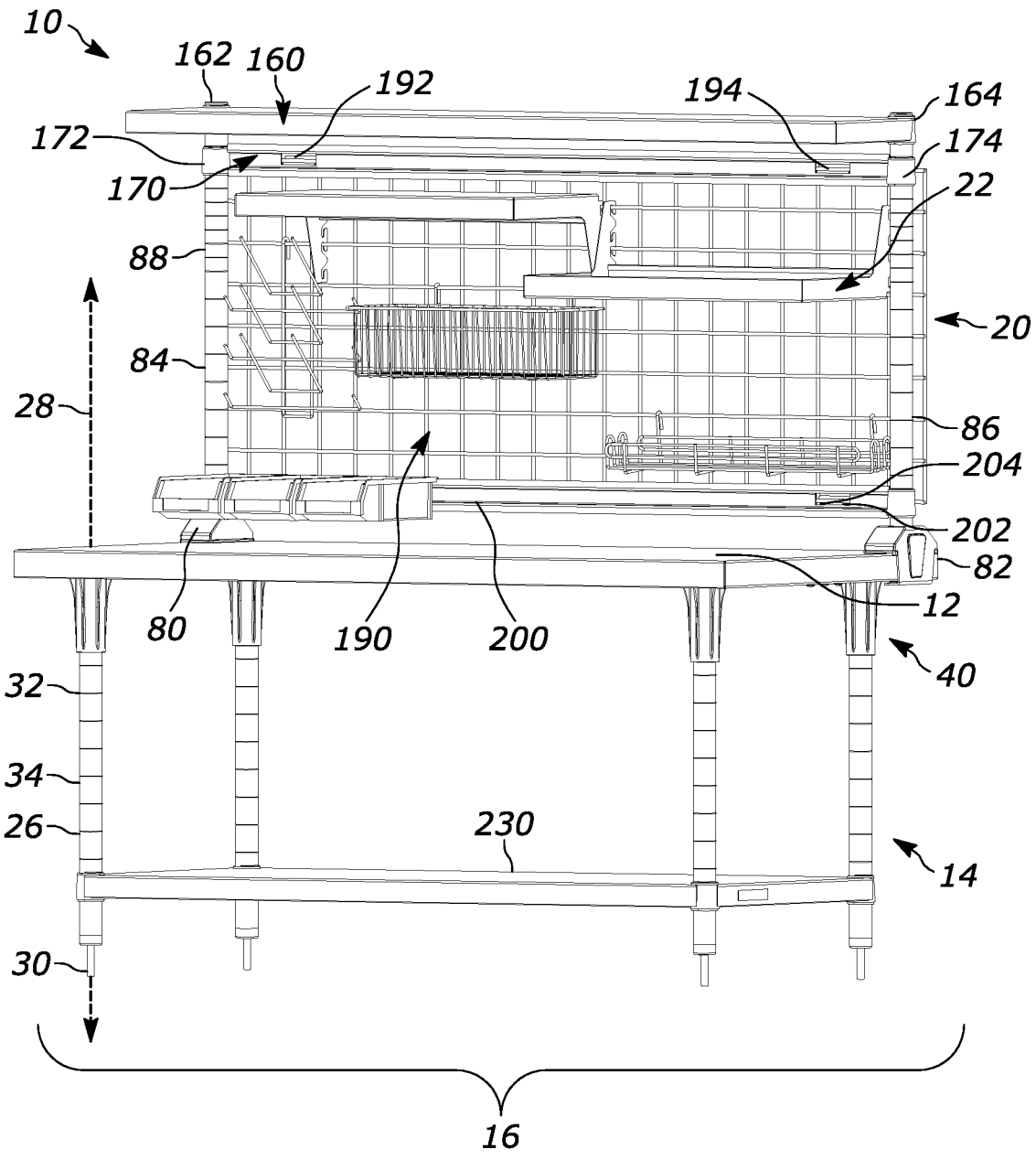
FIG. 1 is a front-right perspective view of an exemplary modular workstation of the present disclosure including a vertically adjustable tabletop worksurface supported by a stationary, solid undershelf, four-column support structure.
Figure 2:
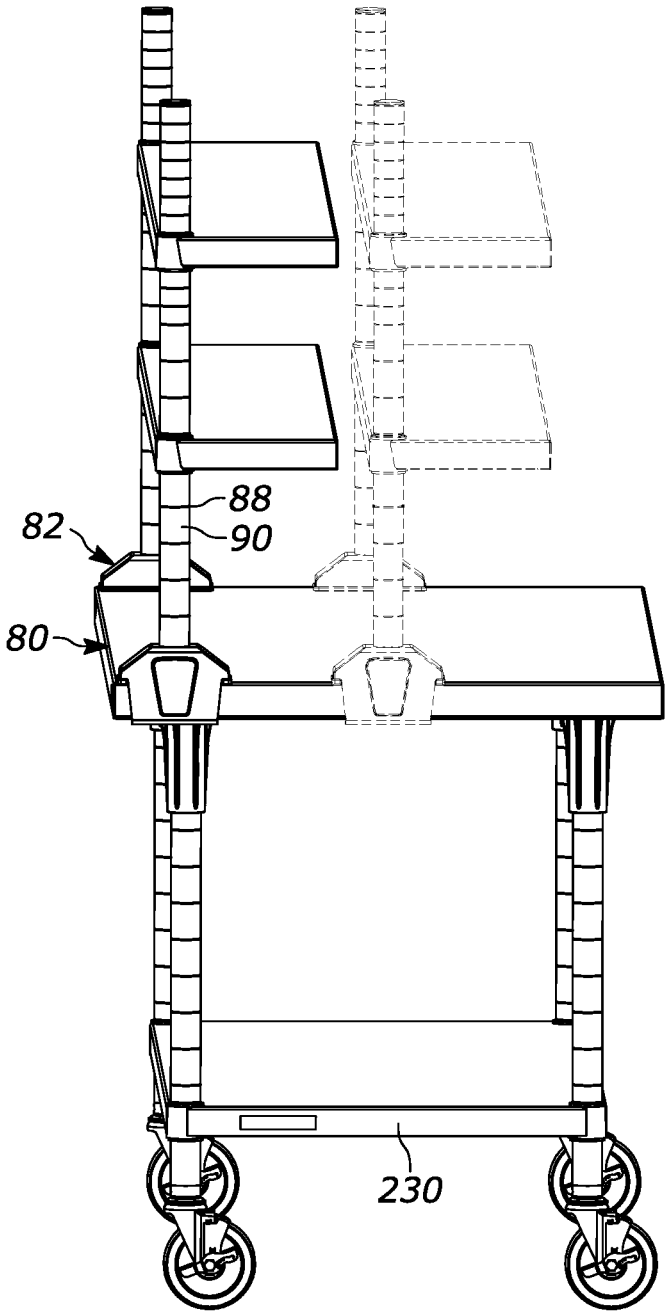
FIG. 2 is a side perspective view of an exemplary modular workstation of the present disclosure including a rear-positioned riser system supporting cantilever shelving above the worksurface with a center position riser system in phantom.
Figure 3:
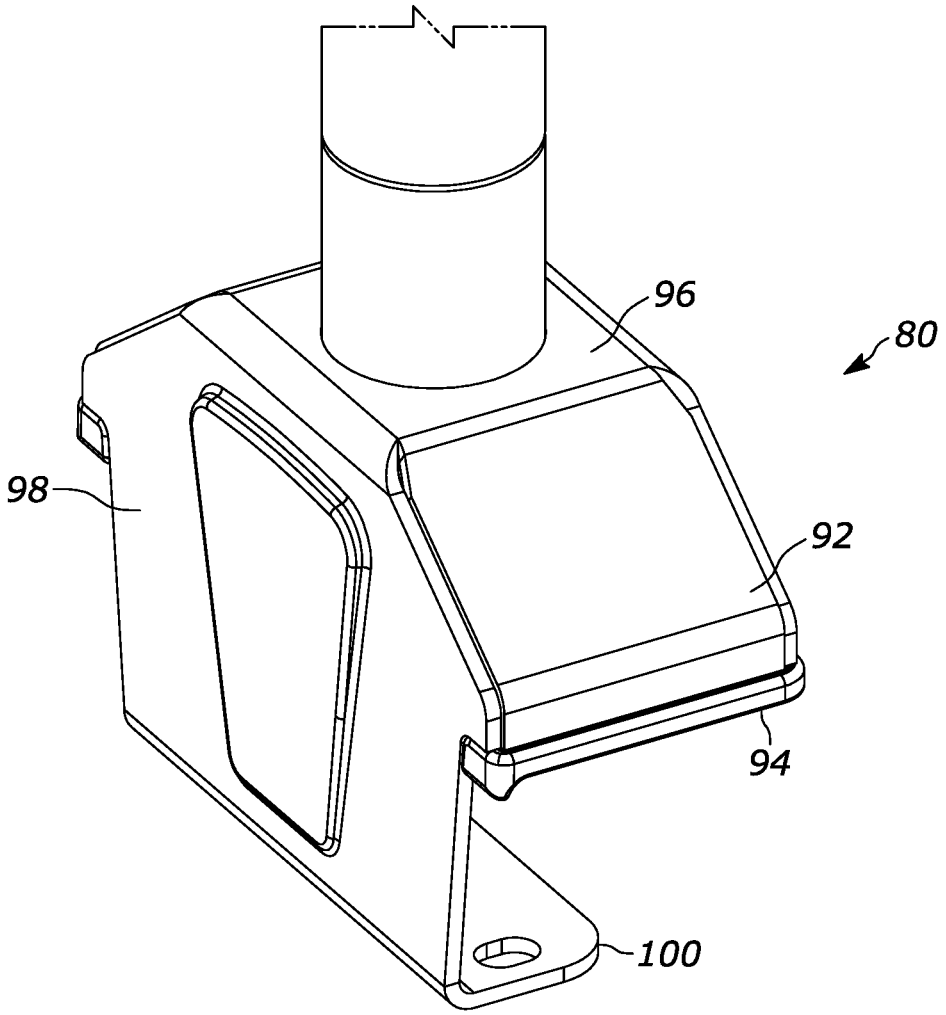
FIGS. 3 and 4 are perspective views of a support bracket for the riser system of the modular workstation of the present disclosure.
Figure 4:
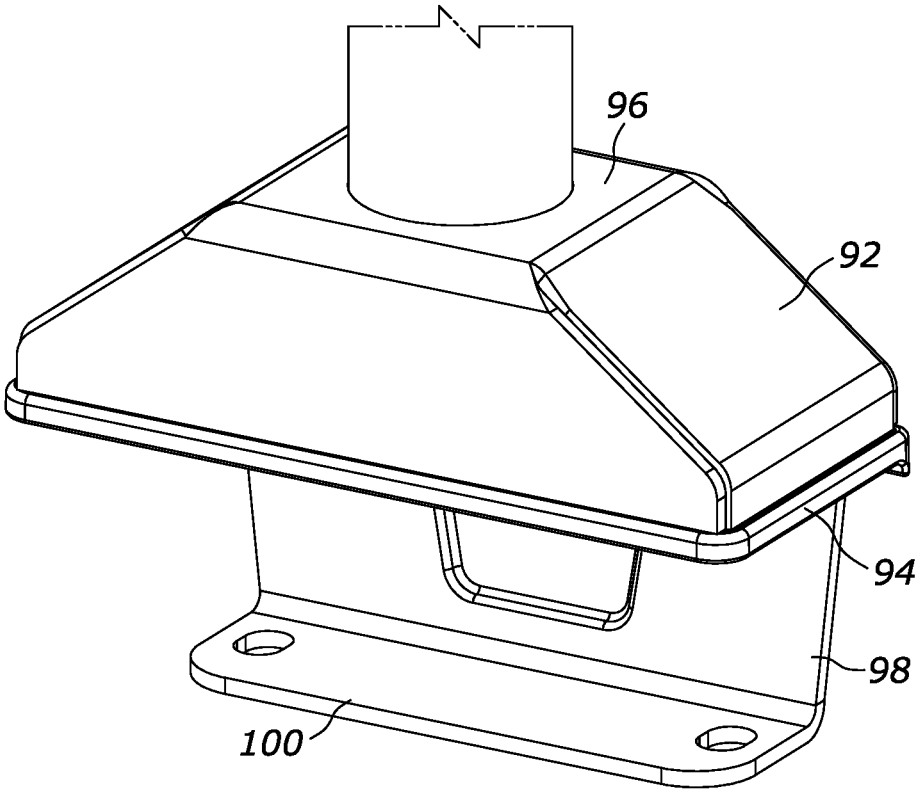
Figure 5:
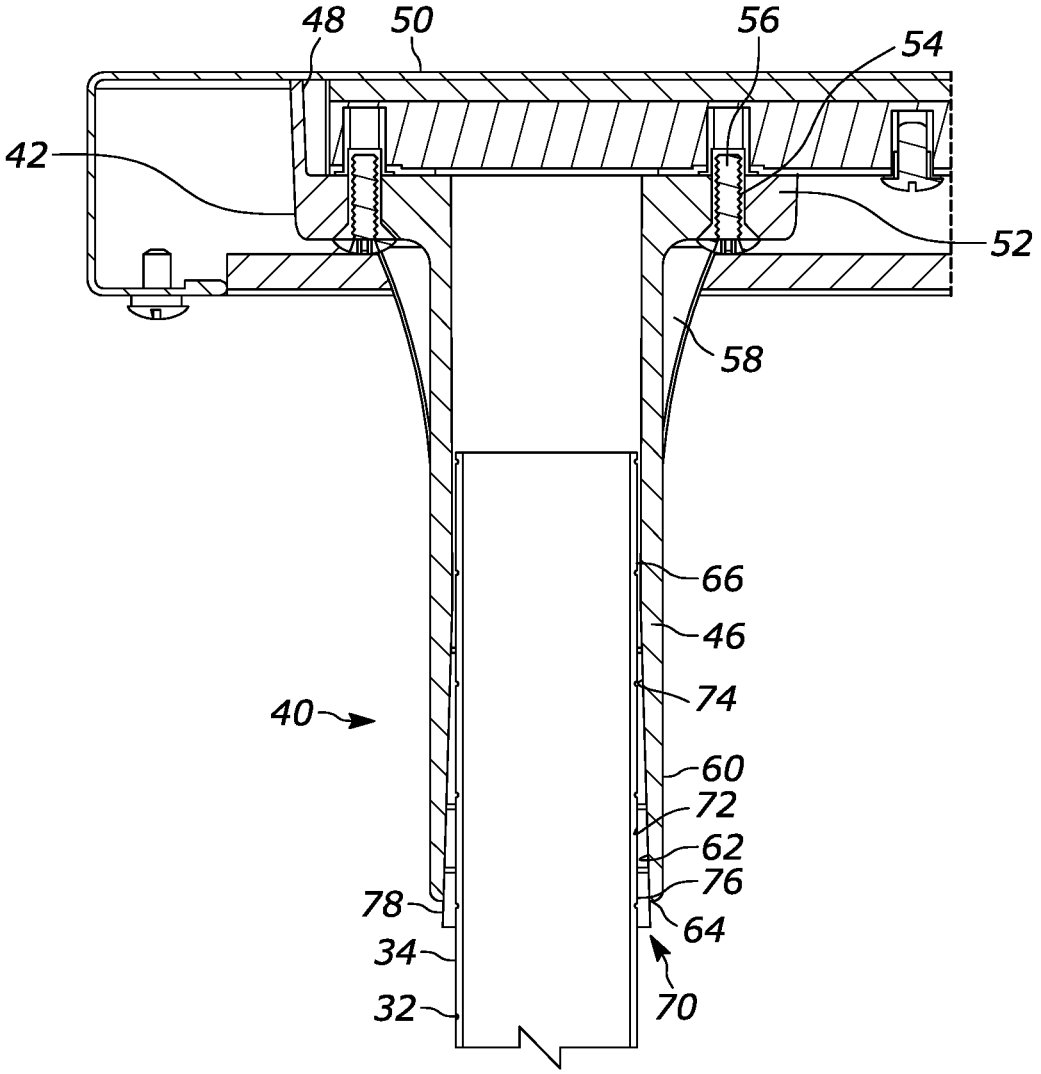
FIG. 5 is a partial, cross-sectional view of a support post mounting system allowing adjustability of the vertical distance of the tabletop and worksurface above a support surface in a modular workstation of the present disclosure.
Figure 6:
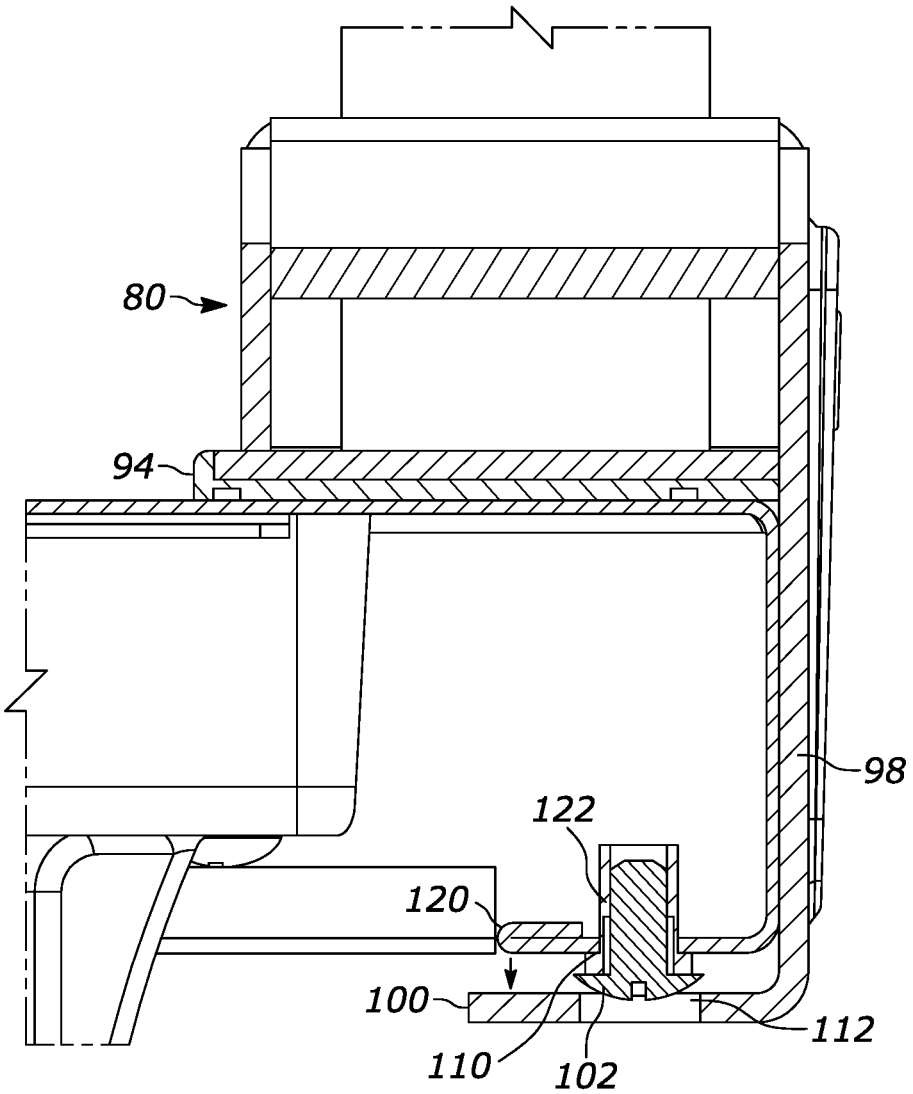
FIG. 6 is a partial, cross-sectional view of a portion of the riser system of the modular workstation of the present disclosure.
Figure 7:
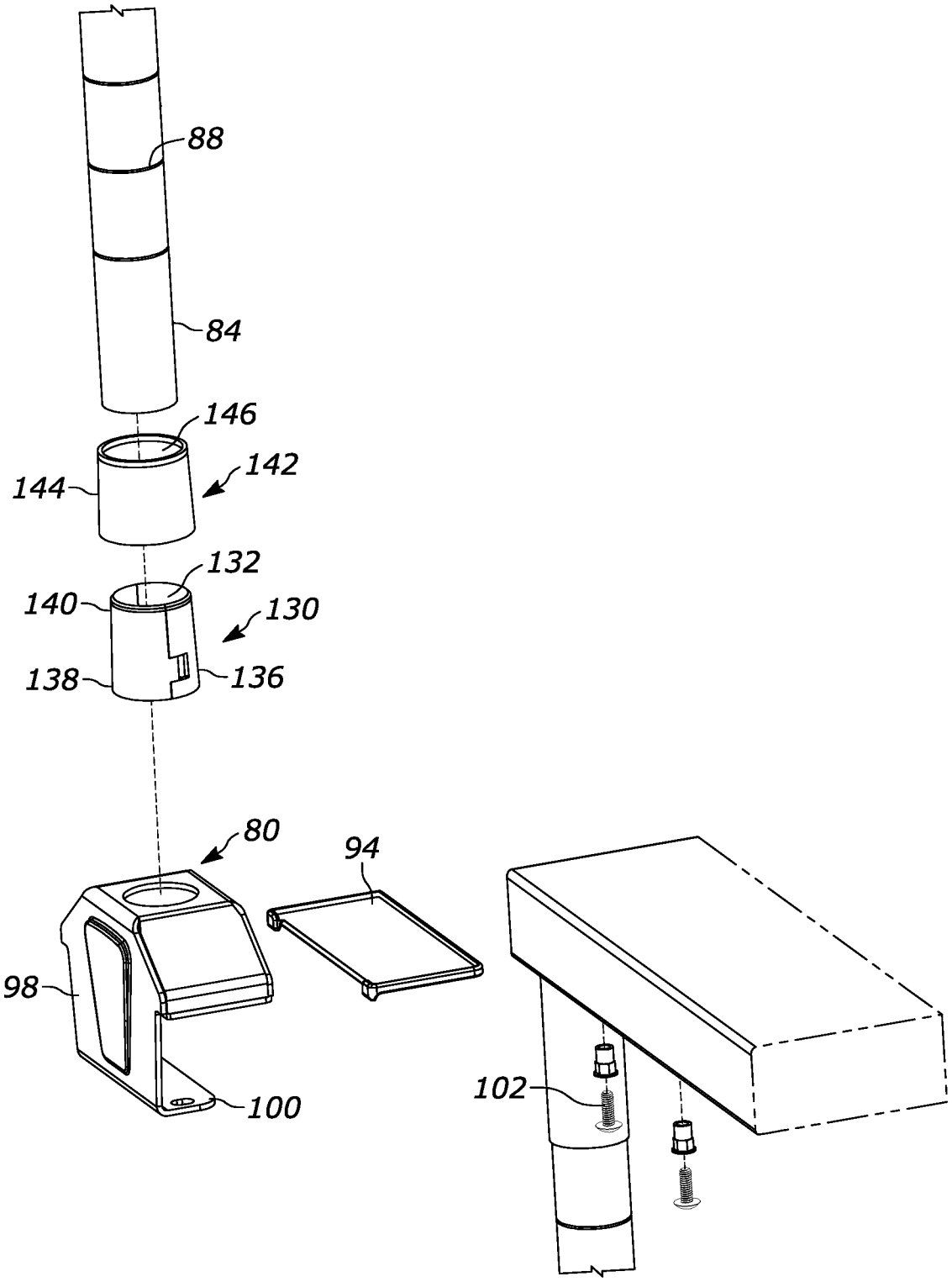
FIG. 7 is a partial, perspective exploded view of the riser system.
Figure 8:
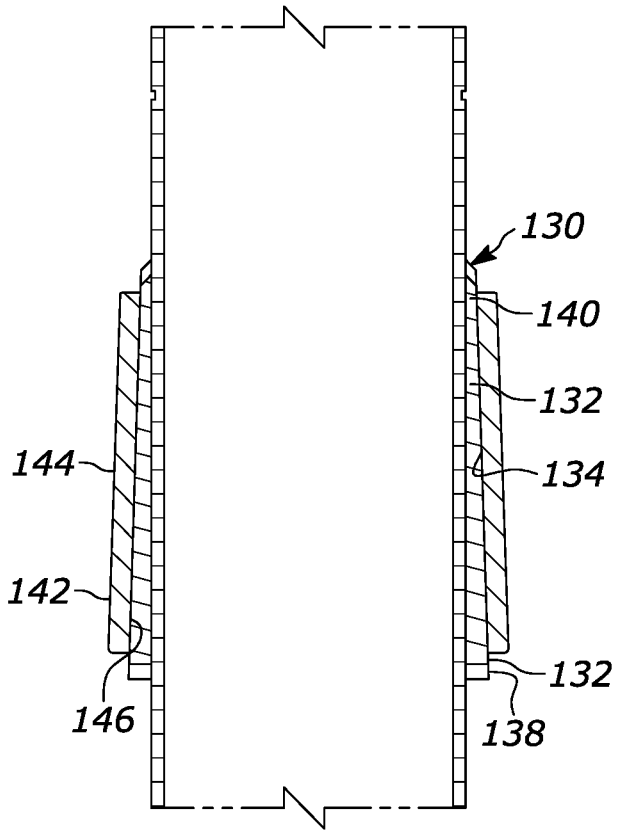
FIG. 8 is a partial, cross-sectional view taken along line 8-8 of FIG. 2 showing a portion of the support column mounting system and the riser system of the modular workstation of the present disclosure.
Figure 9A:
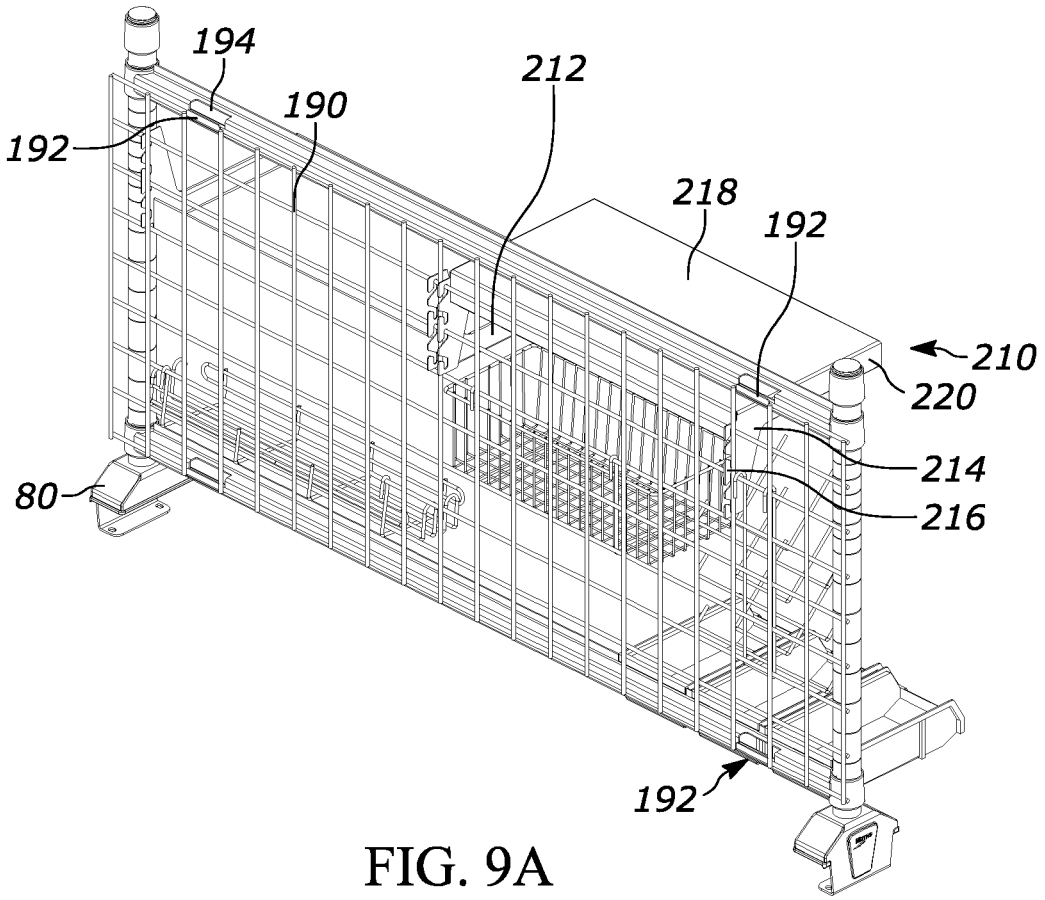
FIG. 9A is a left-front perspective view of a riser system for the modular workstation of the present disclosure supporting a hanger rail, a wire grid and cantilever shelving on opposite sides of the wire grid.
Figure 9B:
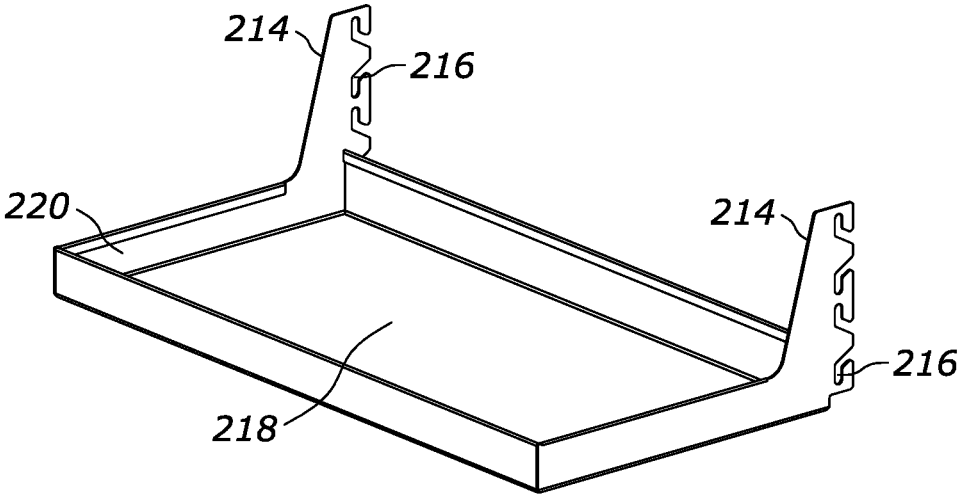
FIG. 9B is a perspective detail view of a first cantilever shelf shown in FIG. 9A.

Example embodiments are illustrated in the drawing figures so that this disclosure will fully convey the scope to those who are skilled in the art. Examples of specific components, devices, and methods, are provided for a thorough understanding of embodiments of the present disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Turning to the figures, a workstation is illustrated and designated with the numeral 10. The workstation 10 includes a tabletop 12, a support structure 14 for supporting the tabletop 12. The support structure 14 is configured to position the tabletop 12 at a vertical distance above a support surface or floor 16. A riser system 20 is secured with the tabletop 12 so that the riser system 20 is positioned above the tabletop 12. Additionally, a storage or accessory device 22 is supported above the tabletop 12 by the riser system 20.

The support structure 14 includes a plurality of fixed length columnar support posts 26. Each posts 26 has a longitudinal axis 28 extending in a vertical direction from a lower end of the post to an upper end of the post. The lower end of the post may include a stop 30 that secures into the post. Alternatively, the stop 30 could be replaced with wheels (not shown) that would enable movement of the workstation 10. The post 26 also includes a plurality of vertically spaced annular grooves 32 and an outer surface 34 of the support post 26. The top end of the posts 26 is received in a tubular post sleeve support 40. The support 40 includes a base 42 and a cylindrical sleeve 46. The base 42 has an overall rectangular configuration with a flange 48 that abuts the tabletop work surface 50. The flange 48 extends from a plate portion 52. The plate portion includes apertures 54 that receive fasteners 56 that secure the tubular post sleeve support to the tabletop 12.

The sleeve 46 extends from the plate 52 and includes reinforcements 58 for the tubular post sleeve support. The sleeve 46 is hollow enabling the support post 26 to be inserted into the sleeve 46. The outer surface 60 of the sleeve has an overall right cylindrical surface. The inner surface 62 has an overall conical surface that tapers inwardly from a first inner diameter 64 adjacent the free end of the sleeve 46. The surface tapers to a second inner diameter 66 near an upper end of the tubular sleeve 46. The second inner diameter is a dimension less than the first inner diameter.

A tubular post collar 70 is positioned near the upper end of each support post 26 and around an outer diameter of surface 34. The tubular post collar 70 has a cylindrical inner surface 72 with one or more raised ribs 74 that are inserted into the grooves 32. Thus, the ribs engage one of the plurality of grooves 32 in order to retain the collar 70 on the post 26. The collar 70 includes a plurality of pieces that form the cylindrical collar 70.

The collar 70 includes a conical outer surface 78 that tapers inwardly from the first outer diameter near a lower end of the tubular post collar to a second outer diameter near an upper end of the tubular post collar. The second outer diameter is less than the first outer diameter. Thus, the tubular post sleeve 46 engages a respective one of the tubular post collars 70 with a wedge fit between the conical surfaces to secure the support post 26 with the tubular post sleeve support 40. This positions the work surface at a vertical distance above the support surface. Also, the tubular post collar 70 can be positioned at various positions along the post 26 enabling the sleeve 46 to provide a telescopic feature to place the work table at desired distances above the support surface. Generally, the sleeve 46 enables a six inch variance of the work table with respect to the support surface. Also, the variance could be more or less.

The riser system 20 includes a first and second riser bracket 80, 82 and first and second fixed length columnar riser support posts 84, 86. The first riser bracket is attached to the tabletop at a first side of the tabletop 12 and the second riser support 82 is attached to the tabletop 12 at a second side of the tabletop. The first fixed length columnar riser support 84 is attached to the first riser bracket 80. The second fixed length columnar riser support 86 is attached to the second riser bracket 82. Each riser support post 84, 86 extends vertically upward from the respective one of the first and second riser brackets 80, 82. Each riser support post 84, 86 includes a plurality of annular grooves 88 in an outer surface 90 of the riser support posts 84, 86.

The riser brackets 80, 82 are substantially the same and thus the explanation of one will apply to both. The bracket has a housing 92 with an overall trapezoidal configuration. A mar plate or bracket seat 94 is positioned under the base of the trapezoidal housing providing a resistant surface. The post 84 extends from a top surface 96 of the housing 92. An extending wall 98 forms one of the sides of the trapezoidal housing. The extending wall includes a flange 100 that projects underneath the base inward so that the tabletop is positioned between the base mar plate 94 and the flange 100. This enables the housing 92 to be secured to the tabletop via a force between the housing 92 and the flange 100.

The underside of the tabletop 12 includes a bottom flange 120 with threaded apertures 122. The threaded apertures 122 enables the button screws 102 to be positioned into the underside of the table. Once the screws 102 are positioned into the threaded apertures 122 of the table, the screws can be backed out applying a force between the bottom flange 120 and flange 100 tightening the housing 92 against the work surface of the tabletop 12. Thus, the screws 102 apply a force pulling away from the tabletop that enables the flange 100 to tighten the housing 92 onto the work surface of the tabletop 12.

The riser post sleeve 130 is disposed over the outer surface of the riser support post. Each riser post sleeve 130 includes a cylindrical inner surface 132 having a second raised annular rib 134 engaging one of the second plurality of annular grooves 88 in the outer surface of the respective riser support posts 84, 86. The sleeve 130 has a conical outer surface 136 that tapers inwardly from a third diameter portion 138 to a fourth diameter portion 140 near an upper end of the riser post collar-sleeve. The fourth diameter is less than the third diameter.

A riser support collar 142 is disposed over the riser support sleeve. The riser support collar 142 can be secured to an accessory or support as explained herein. The collar 142 has an outer cylindrical surface 144. The inner surface 146 tapers inward from a diameter near a lower end of the riser post collar to an outer diameter near an upper end of the riser post collar wherein the third inner diameter is less than the fourth inner diameter.

A cantilevered shelf 160 is supported by the riser post 84, 86 via the riser post sleeve and riser post collar as explained above. Thus, the cantilevered shelf 160 has a first corner support 162 at one end and a second corner support 162 at the other end. Each of the first and second corner supports include a collar with an aperture or bore with a conical inner surface that tapers inward from a third diameter portion near the end of the of the aperture bore to a fourth inner diameter near an upper end of the aperture or bore where the sixth inner diameter is less than the fifth inner diameter. Thus, the first and second corner supports 162, 164 engage the first and second riser post sleeves 130 with a wedge fit to secure the at least one cantilevered shelf 160 to the riser system.

A hanger bar 170 spans between the riser posts 84, 86. The hanger bar includes a first support at one end and a second support at the other end 172, 174. Each of the first supports and second supports comprise a collar with an aperture with a conical inner surface that tapers inwardly from a third inner diameter near a lower end of the aperture to a fourth inner diameter near an upper end of the aperture. The fourth diameter is less than the third diameter. Each of the first and second supports respectively engage the first and second riser post sleeves 130 with a wedge fit to secure the hanger bar to the riser system.

A wire grid 190 may be secured to the hanger bar 170. The hanger bar 170 includes hooks 192 that receive the wire grid 190 to hang the grid 190. Also, an additional hanger bar 200 could be positioned at the bottom of the wire grid 190. The hanger bar 200 includes hooks 202 to receive the wire grid 190.

One or more shelves 210 may be secured to the wire grid 190. The shelves 210 include a bracket 212 with a pair of wire latches 214. The wire latches 214 enable the bracket to be secured to the wire grid 190 in a plurality of orientations. Thus, the latches 214 includes a plurality of cutouts 216 having configuration to mate with the wire grid 190. The bracket 212 can include a floor 218 that is positioned inside of the boundary 220 of the bracket 212 to retain the floor 218 within the bracket 212. Also, the floor 218 could be a unitary or integral part of the bracket boundary 220.

The workstation may include a shelf 230. The bottom bracket 230 is secured to the support posts 26 by tubular sleeves like those described with respect to the riser sleeves. Also, the shelf 230 includes apertures like those described with respect to the hanger bar and the cantilevered shelf. Here, the shelf 230 includes four collars with four sleeves on the posts 26.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A workstation comprising:

a tabletop comprising a work surface;

a support structure for supporting the tabletop, the support structure configured to position the work surface at a vertical distance above a support surface, the support structure comprising:

a plurality of fixed-length, columnar support posts, each support post having a longitudinal axis extending in a vertical direction from a lower end to an upper end and comprising a first plurality of vertically-spaced annular grooves in an outer surface of the support post; and a support post mounting system configured to vary the vertical distance of the work surface above the support surface, the support post mounting system comprising:

a tubular post sleeve disposed over the outer surface of the upper end of each support post, the tubular post sleeve being fastened to the tabletop at an upper end of the tubular post sleeve, the tubular post sleeve comprising a hollow, conical inner surface that tapers inwardly from a first inner diameter near a lower end of the tubular post sleeve to a second inner diameter near an upper end of the tubular post sleeve, wherein the second inner diameter is less than the first inner diameter;

a tubular post collar disposed near the upper end of each support post and around an outer diameter of the support post, the tubular post collar comprising a cylindrical inner surface having a first raised annular rib engaging one of the first plurality of the annular grooves in the outer surface of the support post, and a conical outer surface that tapers inwardly from a first outer diameter near a lower end of the tubular post collar to a second outer diameter near an upper end of the tubular post collar, wherein the second outer diameter is less than the first outer diameter;

wherein each of the tubular post sleeves engage a corresponding one of the tubular post collars with a wedge fit to secure the support post mounting system to the support posts and position the work surface at the vertical distance above the support surface;

a riser system comprising:

first and second riser brackets, wherein the first riser bracket is attached to the tabletop at a first side of the tabletop and the second riser bracket is attached to the tabletop at a second side of the tabletop;

wherein each of the first and second riser brackets comprise a housing including a base, a wall forming a side of the housing, and a flange that extends substantially orthogonally from the wall and beneath the base, wherein the flange is spaced from the base at a fixed distance;

wherein each of the first and second riser brackets are positioned on the tabletop such that the base sits on an upper side of the tabletop and the flange is below a lower side of the tabletop;

at least one screw threadably engaged with the lower side of the tabletop at each of the first side of the tabletop and the second side of the tabletop, wherein the at least one screw is positioned between the flange of a corresponding one of the first and second riser brackets and the lower side of the tabletop, and wherein, when the at least one screw is backed out, the at least one screw is configured to apply a downward force against the flange to secure the riser bracket to the tabletop;

first and second fixed-length, columnar riser support posts attached to a corresponding one of the first and second riser brackets, each of the first and second riser support posts extending vertically upward from the corresponding one of the first and second riser brackets, and each of the first and second riser support posts comprising a second plurality of vertically-spaced annular grooves in an outer surface of the riser support post; and first and second riser post sleeves disposed around an outer diameter of a corresponding one of the first and second riser support posts, each of the first and second riser post sleeves comprising a cylindrical inner surface having a second raised annular rib engaging one of the second plurality of the annular grooves in the outer surface of the corresponding one of the first and second riser support posts, and a conical outer surface that tapers inwardly from a third outer diameter near a lower end of the riser post sleeve to a fourth outer diameter near an upper end of the riser post sleeve, wherein the fourth outer diameter is less than the third outer diameter; and a storage or accessory device supported above the work surface by the riser system.

2. The workstation of claim 1, wherein the storage or accessory device comprises at least one cantilever shelf.

3. The workstation of claim 2, wherein the at least one cantilever shelf extends horizontally from a left end to a right end, wherein the at least one cantilever shelf is supported at the left end by the first riser bracket and first riser support post and at the right end by a second riser bracket and second riser support post, and wherein the at least one cantilever shelf comprises a first corner support at the left end and a second corner support at the right end, wherein each of the first corner support and the second corner support comprise an aperture comprising a conical inner surface that tapers inwardly from a third inner diameter near a lower end of the aperture to a fourth inner diameter near an upper end of the aperture, wherein the fourth inner diameter is less than the third inner diameter; and wherein each of the first and second corner supports respectively engage the first and second riser post sleeves with a wedge fit to secure the at least one cantilever shelf to the riser system.

4. The workstation of claim 2, wherein the storage or accessory device comprises a hanger bar.

5. The workstation of claim 4, wherein the a hanger bar extends horizontally from a left end to a right end, wherein the left end is supported by the first riser bracket and first riser support post and at the right end is supported by a second riser bracket and second riser support post, and wherein the hanger bar comprises a first support at the left end and a second support at the right end, wherein each of the first support and the second support comprise an aperture comprising a conical inner surface that tapers inwardly from a third inner diameter near a lower end of the aperture to a fourth inner diameter near an upper end of the aperture, wherein the fourth inner diameter is less than the third inner diameter; and wherein each of the first and second supports respectively engage the first and second riser post sleeves with a wedge fit to secure the hanger bar to the riser system.

6. The workstation of claim 5, further comprising a wire grid attached to the hanger bar.

7. The workstation of claim 6, further comprising a shelf configured to couple with the wire grid in a plurality of orientations.

8. A system for accommodating at least one of above-the-work surface storage and accessories options in a workstation having a tabletop, the system comprising:

first and second riser brackets, wherein the first riser bracket is attached to the tabletop at a first side of the tabletop and the second riser bracket is attached to the tabletop at a second side of the tabletop;

wherein each of the first and second riser brackets comprise a housing including a base, a wall forming a side of the housing, and a flange that extends substantially orthogonally from the wall and beneath the base, wherein the flange is spaced from the base at a fixed distance;

wherein each of the first and second riser brackets are positioned on the tabletop such that the base sits on an upper side of the tabletop and the flange is below a lower side of the tabletop;

at least one screw threadably engaged with the lower side of the tabletop at each of the first side of the tabletop and the second side of the tabletop, wherein the at least one screw is positioned between the flange of a corresponding one of the first and second riser brackets and the lower side of the tabletop, and wherein, when the at least one screw is backed out, the at least one screw is configured to apply a downward force against the flange to secure the riser bracket to the tabletop;

first and second fixed-length, columnar riser support posts attached to a corresponding one of the first and second riser brackets, each of the first and second riser support posts extending vertically upward from the corresponding one of the first and second riser brackets, and each of the first and second riser support posts comprising a second plurality of vertically-spaced annular grooves in an outer surface of the riser support post; and first and second riser post sleeves disposed around an outer diameter of a corresponding one of the first and second riser support posts, each of the first and second riser post sleeves comprising a cylindrical inner surface having a second raised annular rib engaging one of the second plurality of the annular grooves in the outer surface of the corresponding one of the first and second riser support posts, and a conical outer surface that tapers inwardly from a third outer diameter near a lower end of the riser post sleeve to a fourth outer diameter near an upper end of the riser post sleeve, wherein the fourth outer diameter is less than the third outer diameter; and a storage or accessory device supported above the tabletop.

9. The system of claim 8, wherein the storage or accessory device comprises at least one cantilever shelf.

10. The system of claim 8, wherein the storage or accessory device comprises a hanger bar.

11. The system of claim 10, further comprising a wire grid attached to the hanger bar.

12. The system of claim 8, wherein the storage or accessory device comprises at least one cantilever shelf, a hanger bar, and a wire grid attached to the hanger bar.

13. The system of claim 8, wherein there is a bracket seat on the respective first and second sides of the tabletop.

14. The system of claim 8, wherein the flange of each of the first and second riser brackets comprises at least one aperture; and wherein the at least one aperture is adjacent to the at least one screw.

15. A workstation comprising:

a tabletop comprising a work surface;

a support structure for supporting the tabletop, the support structure configured to position the work surface at a vertical distance above a support surface, the support structure comprising:

a plurality of fixed-length, columnar support posts, each support post having a longitudinal axis extending in a vertical direction from a lower end to an upper end and comprising a first plurality of vertically-spaced annular grooves in an outer surface of the support post; and a support post mounting system configured to vary the vertical distance of the work surface above the support surface, the support post mounting system comprising:

a tubular post sleeve disposed over the outer surface of the upper end of each support post, the tubular post sleeve being fastened to the tabletop at an upper end of the tubular post sleeve, the tubular post sleeve comprising a hollow, conical inner surface that tapers inwardly from a first inner diameter near a lower end of the tubular post sleeve to a second inner diameter near an upper end of the tubular post sleeve, wherein the second inner diameter is less than the first inner diameter;

a tubular post collar disposed near the upper end of each support post and around an outer diameter of the support post, the tubular post collar comprising a cylindrical inner surface having a first raised annular rib engaging one of the first plurality of the annular grooves in the outer surface of the support post, and a conical outer surface that tapers inwardly from a first outer diameter near a lower end of the tubular post collar to a second outer diameter near an upper end of the tubular post collar, wherein the second outer diameter is less than the first outer diameter;

wherein each of the tubular post sleeves engage a corresponding one of the tubular post collars with a wedge fit to secure the support post mounting system to the support posts and position the work surface at the vertical distance above the support surface;

a riser system comprising:

first and second riser brackets, wherein the first riser bracket is attached to the tabletop at a first side of the tabletop and the second riser bracket is attached to the tabletop at a second side of the tabletop;

first and second fixed-length, columnar riser support posts attached to a corresponding one of the first and second riser brackets, each of the first and second riser support posts extending vertically upward from the corresponding one of the first and second riser brackets, and each of the first and second riser support posts comprising a second plurality of vertically-spaced annular grooves in an outer surface of the riser support post; and first and second riser post sleeves disposed around an outer diameter of a corresponding one of the first and second riser support posts, each of the first and second riser post sleeves comprising a cylindrical inner surface having a second raised annular rib engaging one of the second plurality of the annular grooves in the outer surface of the corresponding one of the first and second riser support posts, and a conical outer surface that tapers inwardly from a third outer diameter near a lower end of the riser post sleeve to a fourth outer diameter near an upper end of the riser post sleeve, wherein the fourth outer diameter is less than the third outer diameter; and a storage or accessory device supported above the work surface by the riser system comprising at least one cantilever shelf, a hanger bar, a wire grid attached to the hanger bar, and a shelf configured to couple with the wire grid in a plurality of orientations;

wherein the a hanger bar extends horizontally from a left end to a right end, wherein the left end is supported by the first riser bracket and first riser support post and at the right end is supported by a second riser bracket and second riser support post, and wherein the hanger bar comprises a first support at the left end and a second support at the right end, wherein each of the first support and the second support comprise an aperture comprising a conical inner surface that tapers inwardly from a third inner diameter near a lower end of the aperture to a fourth inner diameter near an upper end of the aperture, wherein the fourth inner diameter is less than the third inner diameter; and wherein each of the first and second supports respectively engage the first and second riser post sleeves with a wedge fit to secure the hanger bar to the riser system.

* * * * *